US005595536A

United States Patent [19]

Cornell

[11] Patent Number: 5,595,536

[45] Date of Patent: Jan. 21, 1997

[54] SHUTTER ASSEMBLIES PARTICULARLY ADAPTED FOR USE ON YACHTS

[76] Inventor: Robert E. Cornell, 621 Margaret St., Key West, Fla. 33040

[21] Appl. No.: 518,142

[22] Filed: Aug. 23, 1995

[51] Int. Cl.[6] ..... F24F 13/15

[52] U.S. Cl. ..... 454/78; 49/74.1; 114/177; 114/211; 454/195; 454/278

[58] Field of Search ..... 454/78, 81, 195, 454/224, 278, 335; 49/74.1, 92.1; 114/177, 178, 211, 212

[56] References Cited

U.S. PATENT DOCUMENTS

| | | | |
|---|---|---|---|
| 433,306 | 7/1890 | Pugsley | 454/224 X |
| 2,077,175 | 4/1937 | Kornabau et al. | 454/81 |
| 2,554,822 | 5/1951 | Geier | 454/195 X |
| 3,008,520 | 11/1961 | Belden et al. | 454/278 X |
| 3,324,785 | 6/1967 | Underdahl | 454/278 |
| 5,191,735 | 3/1993 | Ross | 49/74.1 |

FOREIGN PATENT DOCUMENTS

| | | | |
|---|---|---|---|
| 1103931 | 11/1955 | France | 454/224 |
| 63658 | 8/1913 | Germany | 49/74.1 |

*Primary Examiner*—Harold Joyce
*Attorney, Agent, or Firm*—Renner, Kenner, Greive, Bobak, Taylor & Weber

[57] ABSTRACT

A shutter assembly for an opening adapted to admit light and/or air. The shutter assembly utilizes laterally spaced base members that define a base plane which extends across the opening. The base members may be relatively angularly disposed or parallel. A plurality of parallel, shutter-slats extends between the base members, and each shutter-slat has a longitudinal reference axis, a mounting axis and an input axis. Each mounting axis is disposed in transverse, parallel, spaced relation with respect to the longitudinal reference axis, and the mounting axis of each shutter-slat lies within the base plane. Pivot members secure each shutter-slat to the base members for pivotal movement of each shutter-slat about its mounting axis. The input axis of each shutter-slat is disposed in transversely spaced, parallel relation with respect to the mounting axis. At least one actuator, which is disposed in parallel relation to at least one base member, is pivotally connected to each shutter-slat for relatively pivotal movement of the actuator about the input axis of each shutter-slat in order simultaneously to effect pivotal movement of each shutter-slat about its mounting axis. As the actuator moves closer to a base members, the space between successive shutter-slats is minimized, and when the actuator moves away from the base member the space between the successive shutter-slats is maximized. The shutter-slats may be secured in a desired position by tightening one of the pivot members to prevent the slats from rotating.

7 Claims, 6 Drawing Sheets

SHUTTER ASSEMBLIES PARTICULARLY ADAPTED FOR USE ON YACHTS

TECHNICAL FIELD

The present invention relates generally to coverings for openings that admit light and/or air. More particularly, the present invention relates to shutter assemblies that possess sufficient stability to be particularly adapted for covering openings which may simultaneously move about a plurality of axes. Specifically, the present invention relates to shutter assemblies uniquely adapted for adjustably covering ports, or openings, in ships (hereinafter designated as yachts)—the shutter assembly remaining stable even though the wind and/or wave action causes the yacht to roll about its longitudinal axis, to pitch about its transverse axis and/or to yaw about its vertical axis. A shutter assembly embodying the concepts of the present invention is adapted for use with openings which have non-rectangular borders.

BACKGROUND OF THE INVENTION

Controlling the temperature and the lighting within an enclosure, and particularly inside a vessel such as a ship, yacht or boat is often difficult. Without distinguishing between size, or even whether the vessel is primarily intended for fresh-water or salt-water operation, all vessels will hereinafter be designated generically as yachts.

Yachts are almost constantly exposed to the full affect of weather due to the lack of shelter and shade on the water. The interior living areas of yachts, therefore, are often subjected to uncomfortable warming by direct sunlight, especially on cloudless summer days. Sailors have attempted to cool the interior living area of yachts by using various means such as fans and even air conditioners. Yacht builders combat warming by including ports and hatches that selectively allow air to circulate through the interior in an attempt to dissipate heat. Such ports and hatches are also quite often designed to minimize the obstruction of at least outwardly directed visibility. Design limitations such as the shape of the yacht and the limited freeboard above the water line often force the shape of the openings to be non-rectangular.

One inexpensive and effective method of preventing the interior of a yacht from warming is to use coverings in conjunction with the ports in order to control the admission of sunlight. Thus, while solid coverings, akin to window shades, are extremely effective for blocking sunlight, they are generally deemed to be undesirable because they block both airflow and visibility. In addition, a solid covering typically hangs from the top of the opening and can swing and strike against the casing that defines the opening as the yacht moves about one or more of its three primary axes. Such movement occurs as the yacht traverses the waves, as waves strike the yacht, or (depending on the size of the yacht) when people move about on the yacht. The typical multi-axis movement of a yacht creates excessive wear, and undesirable noise, when a covering device simply hangs from the top of the casing in a manner that allows the covering device independently to respond to the movement of the yacht. The covering may also be fastened to the bottom of the casing, but the undesirable blocking of the airflow and sight line visibility remains.

Venetian blinds typically comprise a plurality of parallel, horizontal slats that are suspended one above another so that they may be simultaneously adjusted. Venetian blinds may be adjusted to prevent penetration of the direct rays of sunlight while allowing light to enter. Venetian blinds are also desirable in that they may be readily adjusted so as not to obscure sight line visibility. Venetian blinds typically hang from the top of the casing, and the working parts of the blinds are normally covered by a valance. The working parts, or adjustment devices, generally hang downwardly from the valance.

When the plurality of slats are not connected at the bottom of the casing, the slats slap against the casing as well as the sash in response to the multi-axis movement of the yacht. The adjustment mechanisms also swing freely and slap against the blinds. A further disadvantage to the use of venetian blinds is that they are impractical for use with overhead hatches. When attached to overhead hatches both the "top" and "bottom" are fastened to the hatch, or its frame, and the array of slats bow downwardly. Moreover, the adjustment mechanisms hang freely downwardly into the living area beneath the overhead hatch.

SUMMARY OF THE INVENTION

It is, therefore, a primary object of the present invention to provide a novel shutter assembly that remains stable when used in conjunction with openings subjected to movement.

It is another object of the present invention to provide a shutter assembly, as above, the concepts of which makes it as readily adaptable for use with non-rectangular as with rectangular openings.

It is a further object of the present invention to provide a shutter assembly, as above, that has no loose or swinging elements when operatively mounted.

It is still another object of the present invention to provide a shutter assembly, as above, that only minimally reduces the area of the opening with which the shutter assembly is used.

It is yet another object of the present invention to provide a shutter assembly, as above, that may employ horizontally, vertically or obliquely disposed shutter-slats.

It is an even further object of the present invention to provide a shutter assembly, as above, that does not require a valance to cover any working parts.

These and other objects of the invention, as well as the advantages thereof over existing and prior art forms, which will be apparent in view of the following detailed specification, are accomplished by means hereinafter described and claimed.

In general, a shutter assembly embodying the concepts of the present invention has first and second base members that define a base plane which extends across the opening with which the shutter assembly is being used. A plurality of parallel, shutter-slats extend between the base members, and each shutter-slat has a mounting axis and an input axis. The input axis of each shutter-slat is disposed in parallel, spaced relation with respect to the mounting axis. The mounting axis of each shutter-slat lies within the base plane defined by the base members. Pivot means secure each shutter-slat to the base members for at least partial pivotal movement of each shutter-slat about its mounting axis.

At least one actuator, or adjusting member, is secured to the input axis of each shutter-slat for relative pivotal movement of each shutter-slat with respect to the actuator (or vice versa) about the input axis.

To acquaint persons skilled in the arts most closely related to the present invention, one preferred embodiment of a shutter assembly that illustrates a best mode now contemplated for putting the invention into practice, together with one variation thereof, are described herein by, and with reference to, the annexed drawings that form a part of the specification. The exemplary shutter assembly, and the variation thereof, are described in detail without attempting to show all of the various forms and modifications in which the invention might be embodied. As such, the embodiments shown and described herein are illustrative, and as will become apparent to those skilled in these arts, can be modified in numerous ways within the scope and spirit of the invention; the invention being measured by the appended claims and not by the details of the specification.

DESCRIPTION OF AN EXEMPLARY EMBODIMENT

Figure 1:
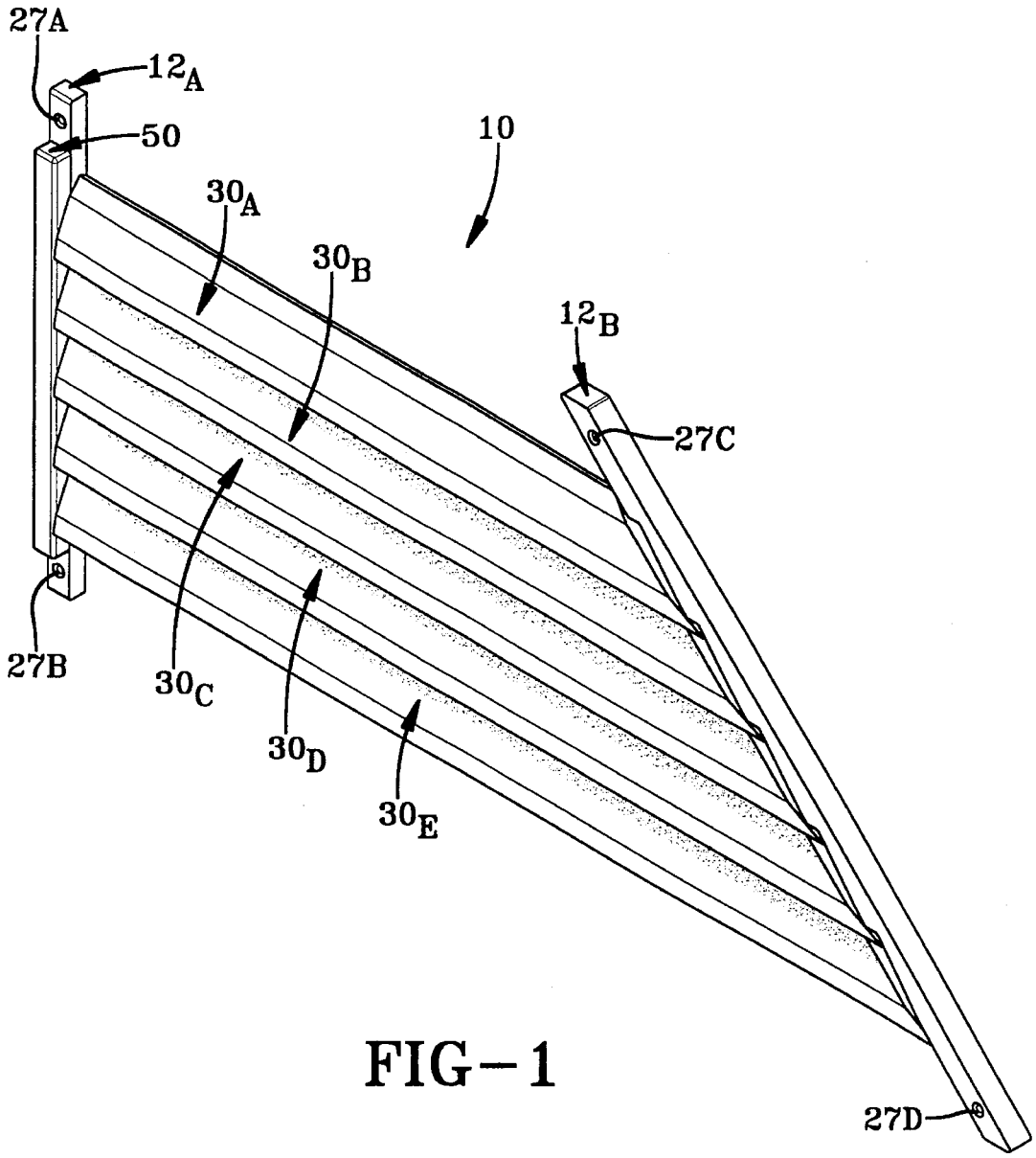
FIG. 1 is a perspective view of a shutter assembly embodying the concepts of the present invention, the shutter assembly depicted being particularly adapted for use with a trapezoidal-shaped opening.
Figure 3:
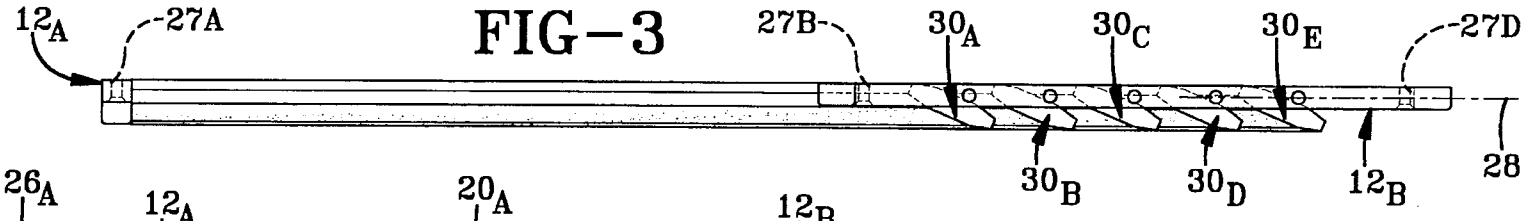
FIG. 3 is a top plan view of the shutter assembly depicted in FIGS. 1 and 2.

One representative form of shutter assembly embodying the concepts of the present invention is designated generally by the numeral 10 on FIGS. 1 through 6 of the accompanying drawings. The representative shutter assembly 10 utilizes a pair of laterally spaced base members $\mathbf{12}_A$ and $\mathbf{12}_B$ that may be removably, or permanently, mounted on the frame, or casing, 14 (FIG. 2) that delineates the boundaries of an opening 16—such as a port, or hatch. In some installations (which are not depicted) the base members $\mathbf{12}_A$ and $\mathbf{12}_B$ may be removably, or permanently, mounted on the sash 18 that is received within the opening 16.

A sash 18 typically comprises horizontally disposed rails $\mathbf{20}_A$ and $\mathbf{20}_B$ that are respectively conjoined to the vertical, or vertically inclined, stiles $\mathbf{22}_A$ and $\mathbf{22}_B$. The sash 18 may, as shown, be hinged to the frame, or casing, 14.

Irrespective of whether the shutter assembly 10 is mounted on the frame 14, or the sash 18, selective disposition of the base members 12 allow the shutter assembly 10 to be installed in conjunction with non-rectangularly shaped openings. In either situation, the base members 12 are simply mounted to conform to the shape of opening 16 with which the shutter assembly 10 is to be associated. As such, the base members 12 may be horizontally spaced, as shown, or they may be vertically spaced.

Figure 2:
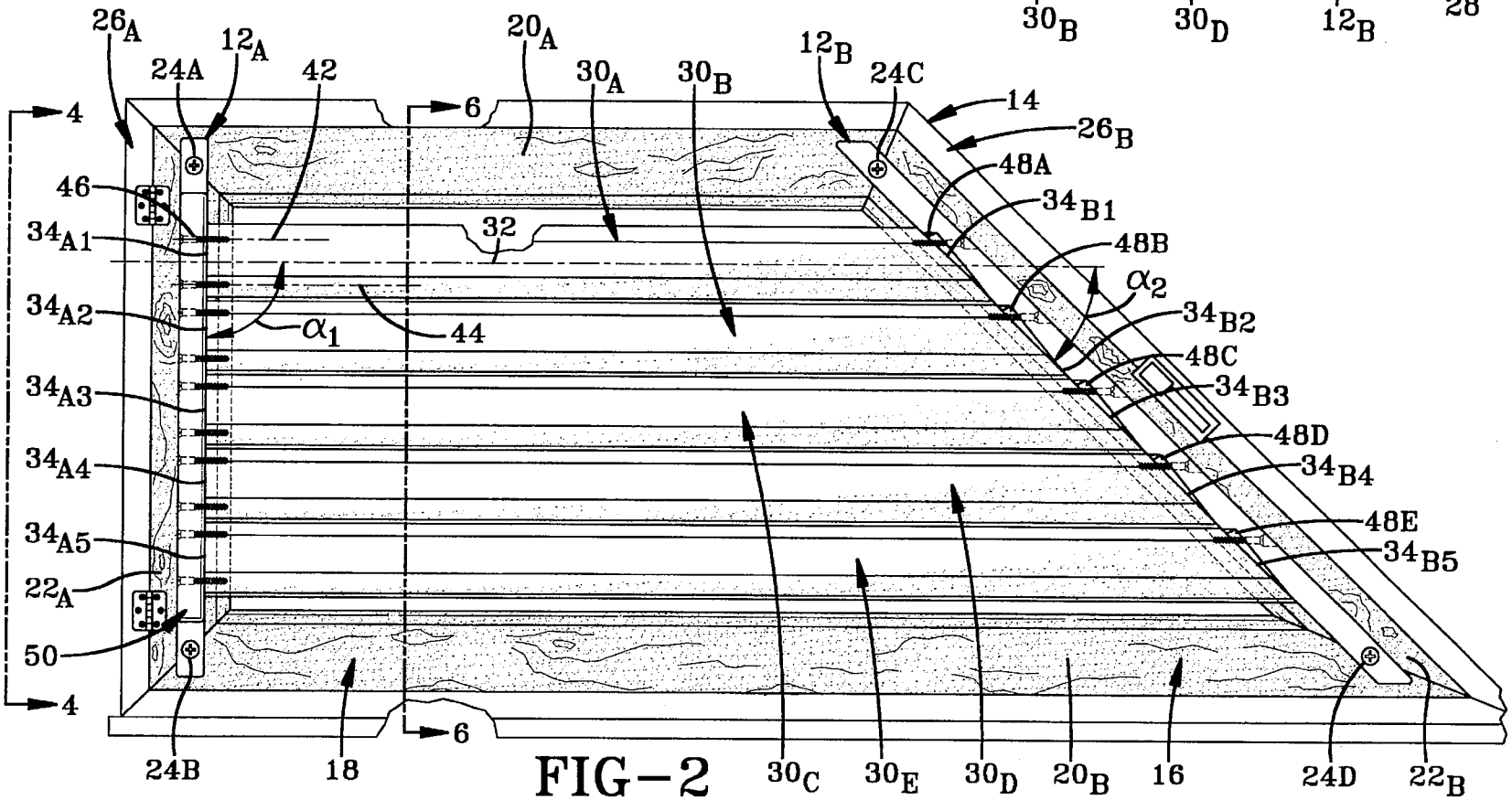
FIG. 2 is a frontal elevation of the shutter assembly depicted in FIG. 1, but with the shutter assembly represented as being mounted on the frame of a sash—mounted for being opened or closed within a casing—that delineates a representative opening in the nature of a port and thus of the type for which the present invention is particularly adapted.

If the shutter assembly 10 is to be mounted on the frame, or casing, 14 (as shown in FIG. 2), a plurality of mounting fastener means in the nature of screws 24A through 24D may be used to secure the base members $\mathbf{12}_A$ and $\mathbf{12}_B$ to the corresponding side trim members $\mathbf{26}_A$ and $\mathbf{26}_B$ of the frame 14. On the other hand, if the shutter assembly 10 were to be installed on the sash 18, the base members $\mathbf{12}_A$ and $\mathbf{12}_B$ could be secured to the corresponding stiles $\mathbf{22}_A$ and $\mathbf{22}_B$ by an identical plurality of fastener means that may, for convenience, be received in pre-drilled bores 27A through 27D.

As previewed in the previous paragraph, and as will appear in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are a plurality of fastener means that are generally identified by the numeral 24, but the specific, individual fastener means are, therefore, identified as 24A through 24D in the specification and on the drawings.

Similarly, there are at least two base members in the shutter assembly. The base members may mirror each other, or they may have widely diverse orientations which require concomitantly differing lengths and/or dispositions. When referring generally to that type of structural member, component or arrangement a common numerical designation shall be employed. However, when one of the structural members, components or arrangements so identified is to be individually identified it shall be referenced by virtue of a letter subscript employed in combination with the numerical designation employed for general identification of that structural member, component or arrangement. Thus, there are two base members which are generally identified by the numeral 12, but the specific, individual base members are, therefore, identified as $\mathbf{12}_A$ and $\mathbf{12}_B$ in the specification and on the drawings. These suffix conventions shall be employed throughout the specification.

When the base members $\mathbf{12}_A$ and $\mathbf{12}_B$ are secured either to the side trim members $\mathbf{26}_A$ and $\mathbf{26}_B$, respectively, of the frame 14 or to the stiles $\mathbf{22}_A$ and $\mathbf{22}_B$, respectively, of the sash 18, the spaced base members $\mathbf{12}_A$ and $\mathbf{12}_B$ define the operating plane 28 within which the shutter assembly 10 is disposed. It is this operating plane 28 within which the hereinafter described shutter-slats 30 are pivotally mounted to the base members 12.

The shutter assembly 10 employs a plurality of the longitudinally extending shutter-slats $\mathbf{30}_A$, $\mathbf{30}_B$, $\mathbf{30}_C$, etc. that are disposed in parallel relation to each other. A reference axis 32 extends along the longitudinal centerline of each shutter-slat 30 to intersect the first and second ends $34_A$ and $34_B$, respectively, of each shutter-slat 30. The ends $34_{A1}$, $34_{A2}$, $34_{A3}$, etc. are disposed to lie parallel to the adjacent base member $12_A$, and the ends $34_{B1}$, $34_{B2}$, $34_{B3}$, etc. are disposed to lie parallel to the adjacent base member $12_B$—as is particularly apparent when the shutter-slats 30 are in their fully closed position depicted in FIGS. 1 and 2.

Because the shutter-slats 30 are disposed in perpendicular relation to the base member $12_A$, the end $34_A$ of each shutter-slat 30 may be disposed perpendicularly with respect to the longitudinal reference axis 32, as represented by $\alpha_1$ in FIG. 2. However, because the embodiment of the shutter assembly 10 depicted in FIGS. 1 through 6 is intended for use in a non-rectangular opening 16—and one which requires that the base member $12_B$ converge upwardly toward the laterally displaced, substantially vertical (as viewed in FIG. 2) base member $12_A$. When the ends $34_{B1}$, $34_{B2}$, $34_{B3}$, etc. are parallel to the side member $12_B$, those ends $34_{B1}$, $34_{B2}$, $34_{B3}$, etc. are angularly disposed with respect to the longitudinal reference axis 32. In the representative embodiment depicted, each end $34_B$ is disposed at approximately sixty degrees (60°), as represented by $\alpha_2$ in FIG. 2, with respect to the longitudinal reference axes 32.

The cross sectional configuration of the shutter-slat 30 depicted is not critical to the operation of the shutter assembly 10 in conformity with the concepts of the present invention. Even so, it may be noted that each shutter-slat 30 may have opposed, parallel, planar surfaces 36A and 36B that merge to intersect the apices 38A and 38B through the inclined, transitional surfaces $40A_1$ and $40A_2$ on one side of each shutter-slat 30 and through the inclined, transitional surfaces $40B_1$ and $40B_2$ on the other side of each shutter-slat 30. The apices 38 may be rounded, or squared, as desired. Irrespective of their exact configuration, the longitudinal extent of the opposite apices 38 define the first and second edges of each shutter-slat 30.

A mounting axis 42 extends longitudinally along the interior of each shutter-slat 30 in proximity to the edge defined by apex 38A of each slat. The mounting axis 42 preferably lies parallel to the longitudinal reference axis 32. An input axis 44 extends longitudinally along the interior of each shutter-slat 30 in proximity to the opposite edge defined by apex 38B of each slat, and the input axis 44 also lies parallel to, but on the opposite side of, the longitudinal reference axis 32.

When the shutter-slats 30 are positioned for operation within the shutter assembly 10, the mounting axis 42 of each shutter-slat 30 is disposed within the operating plane 28, and the shutter-slats 30 are each secured to the base members 12 for the desired rotation about pivot members 46, one of which extends through base member $12_A$ and into the adjacent end $34_A$ of each shutter-slat 30. An opposed pivot member 46 extends through base member $12_B$ and into the adjacent end $34_B$ of each shutter-slat 30. The opposed pivot members 46 are disposed to lie in congruity with the mounting axis 42 of each shutter-slat 30 so that each shutter-slat 30 may rotate about its respective mounting axis 42.

The pivot members 46 also support the weight of each shutter-slat 30. In the preferred embodiment of the present invention, wood screws are employed as the pivot members 46. In other embodiments of the present invention means (not depicted) other than screws may be employed as the pivot members 46. Other such means may be molded or otherwise formed directly into the base members $12_A$ and $12_B$ and/or the shutter-slats 30.

It should be noted that when the angular disposition $\alpha$ of the shutter-slats 30 (as delineated by the longitudinal reference axis 32) with respect to either base member 12 is less than ninety degrees (90°), a notch 48 must be formed in that base member $12_B$ (as depicted) for each shutter-slat 30 in order to permit each shutter-slat 30 to pivot about its respective mounting axis 42 without interfering engagement between the inclined end $34_B$ and the adjacent, inclined base member $12_B$.

At least one actuator, or adjusting, bar 50 is pivotally connected to the input axis 44 of each shutter-slat 30. As depicted, the actuator 50 is secured to the input axis 44 of each shutter-slat 30 for the desired relative rotation between the shutter-slats 30 and the actuator 50 about their individual input axis 44, as defined by the pivot members 47, one of which extends through base member $12_B$ and into the adjacent end $34_B$ of each shutter-slat 30. The pivot members 47 which connect the actuator 50 to each shutter-slat 30 are disposed to lie in congruity with the input axis 44 of each shutter-slat 30 so that the actuator 50 may rotate about the input axis 44 of each shutter-slat 30.

Figure 4:
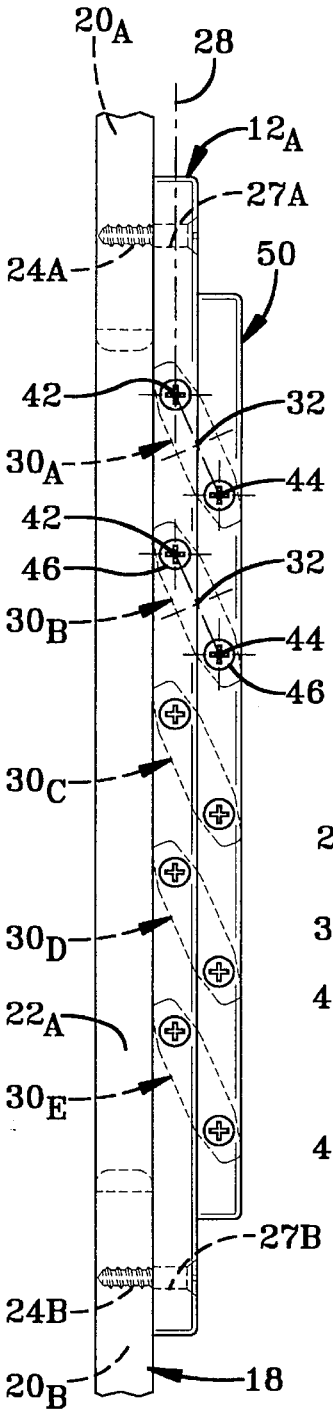
FIG. 4 is a side elevation of the shutter assembly, said elevation being taken substantially along line 4—4 of FIG. 2 to depict the sash but not the casing.
Figure 5:
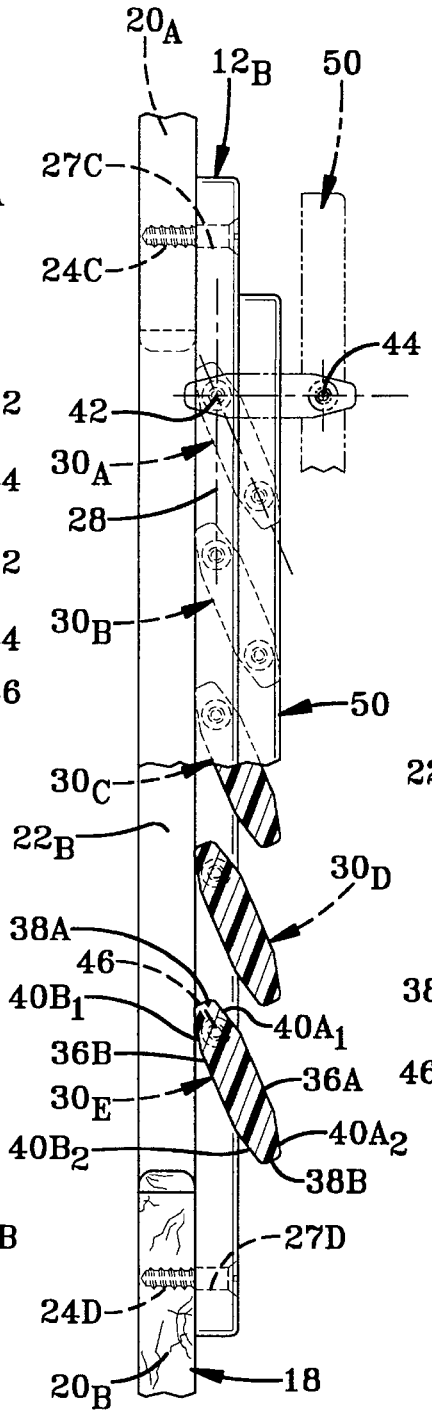
FIG. 5 is a view similar to FIG. 4, but partly broken away to depict the shutter assembly in its fully closed position.
Figure 6:
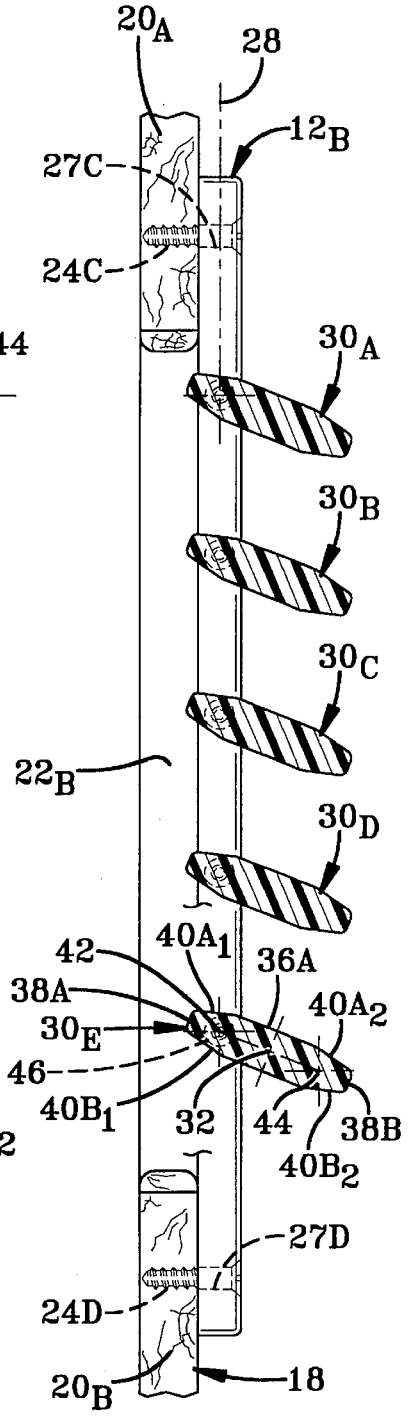
FIG. 6 is a view similar to FIG. 5 but taken substantially along line 6—6 of FIG. 2 to depict the shutter assembly in its fully open position.
Figure 7:
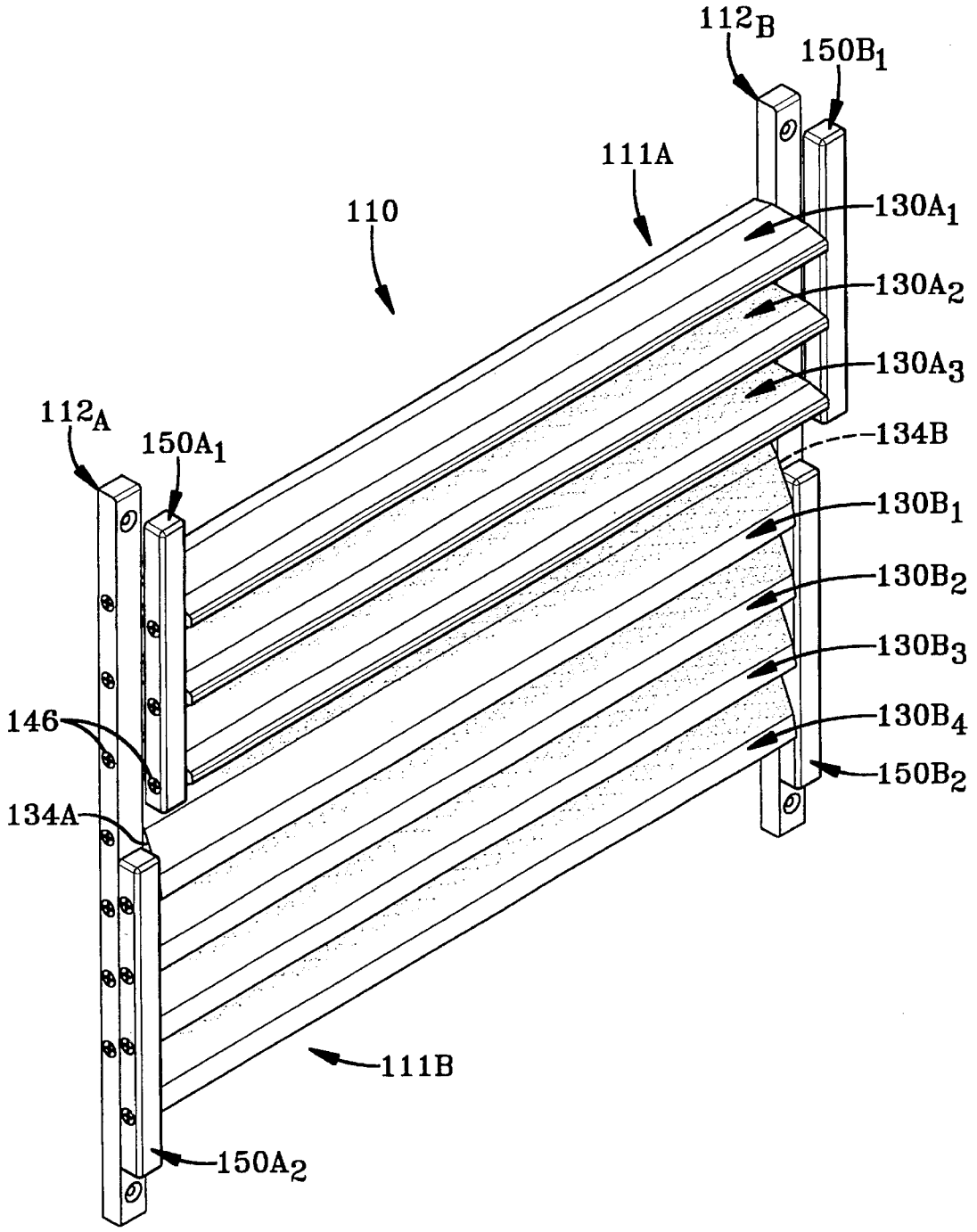
FIG. 7 is a perspective view of a variation of a shutter assembly embodying the concepts of the present invention, the shutter assembly having independently operable upper and lower shutter sub-assemblies.
Figure 9:
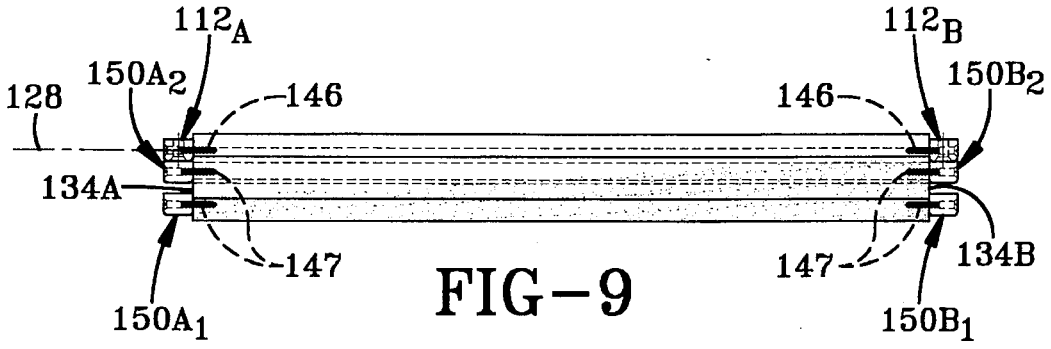
FIG. 9 is a top plan view of the shutter assembly depicted in FIG. 8.
Figure 8:
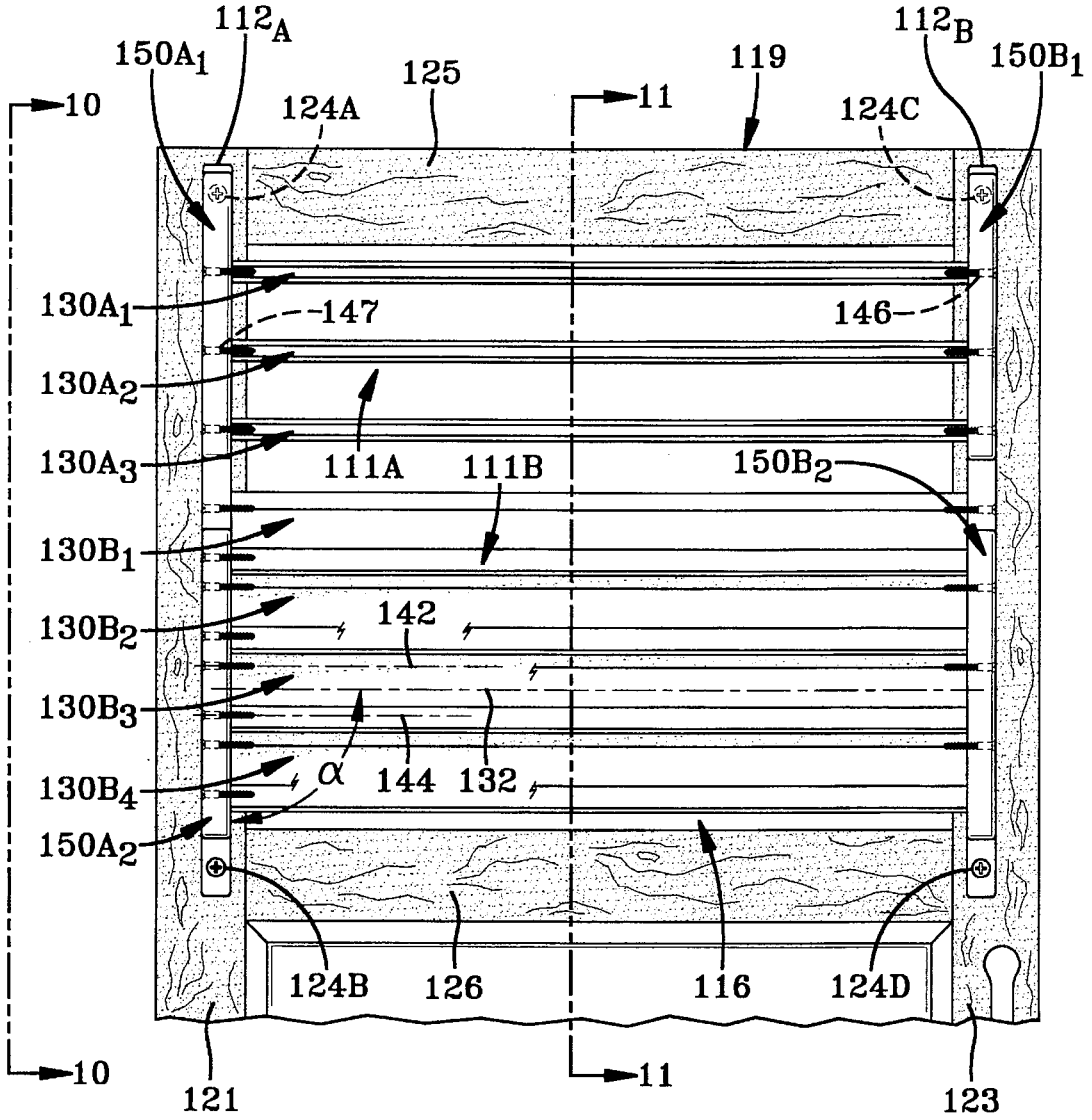
FIG. 8 is a frontal elevation of the shutter assembly depicted in FIG. 7, but with the shutter assembly represented as being mounted on a hatch in the nature of a door having an opening in lieu of a top panel and with the shutter assembly covering the opening.
Figure 10:
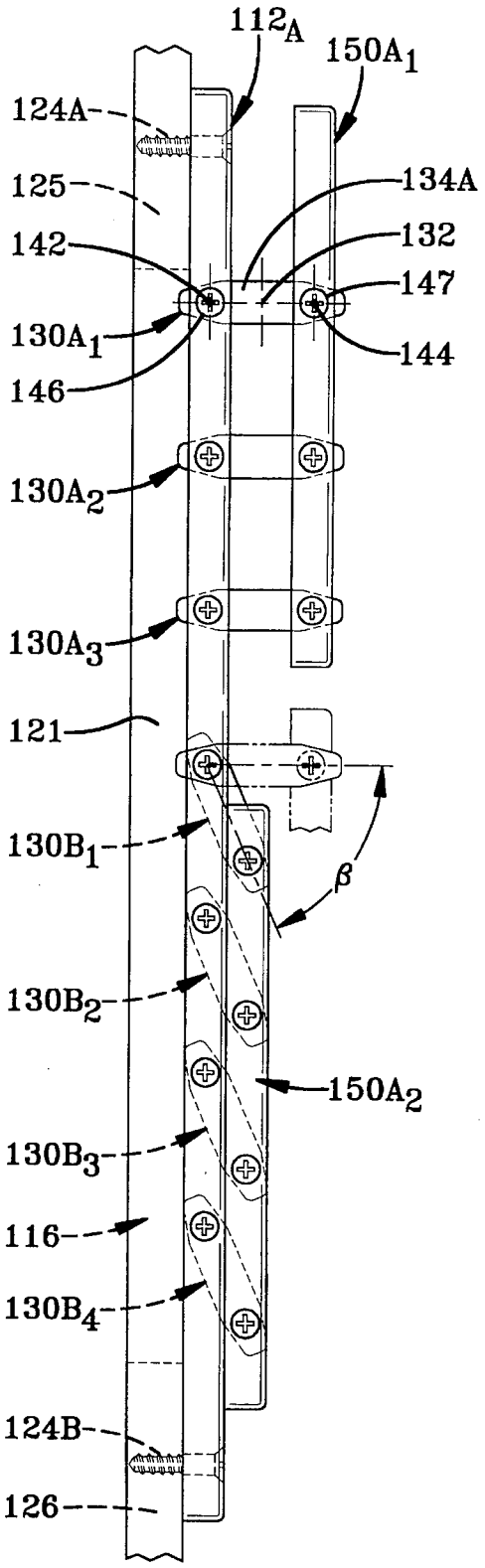
FIG. 10 is an enlarged side elevation taken substantially along line 10—10 of FIG. 8 to depict the upper sub-assembly in its fully open position and to depict the lower sub-assembly in its fully closed position; and, FIG. 11 is an enlarged vertical section taken substantially along line 11—11 of FIG. 8.
Figure 11:
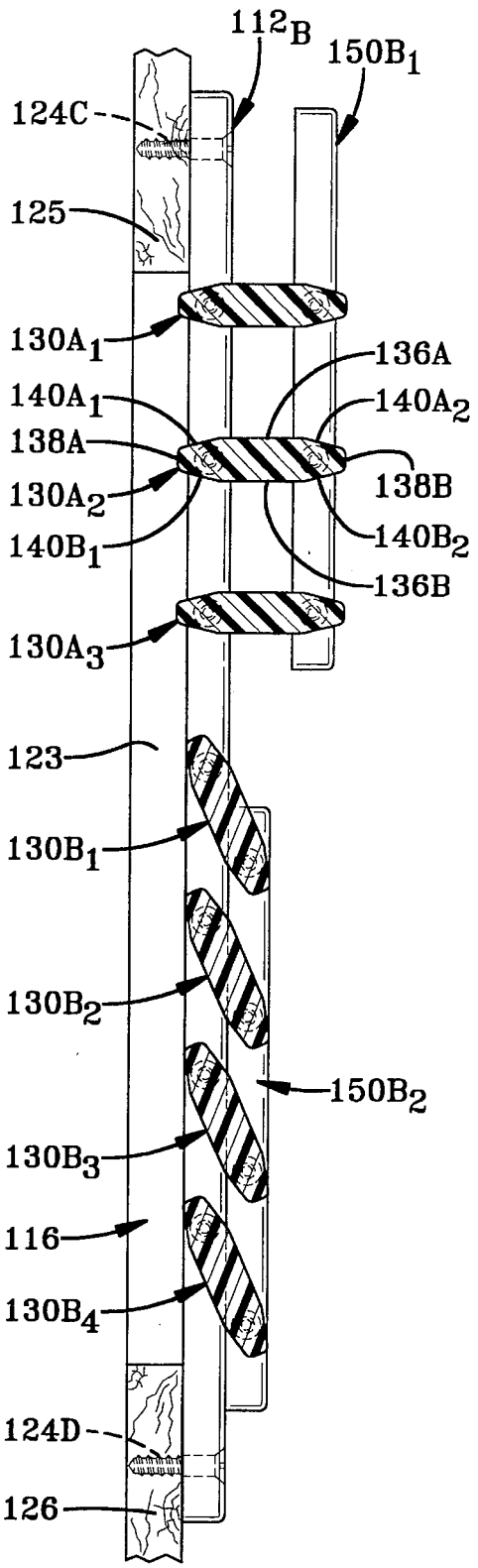

As a result of the geometric relationships between the shutter-slats 30, the base members 12 and the actuator 50, when the actuator 50 is translated, all of the shutter-slats 30 are simultaneously pivoted about their respective mounting axes 42. When the actuator 50 is translated, it remains parallel to the base member $12_A$. When the actuator 50 is translated such that it engages the base member $12_A$, as shown in FIGS. 4 and 5, the shutter assembly 10 is closed, and the space between the successive shutter-slats 30 is minimized. As the actuator 50 is translated away from the base member $12_A$, the shutter-slats 30 move toward the open position represented in FIG. 6. When the actuator 50 is farthest away from the base member $12_A$, the shutter assembly 10 is open, and the space between the successive shutter-slats 30 is maximized.

It should be appreciated that when screws are employed as the pivot members 46 and/or 47, the tightness of the screws determines the amount of force necessary to move the actuator 50. When the shutter assembly 10 is installed on a moving conveyance, such as a yacht, the amount of force necessary to adjust the shutter-slats 30 may be readily adjusted to prevent the shutter-slats 30 from moving in response to the movement of the yacht. It also follows that the shutter-slats 30 may be locked in any desired position by tightening any one of the screws that serve as the pivot member 46 or 47. When screws are not employed as the pivot members, another device, such as a thumbscrew, may be interposed between one of the shutter-slats 30 and either side member 12 or the actuator 50 selectively to control the force required to actuate the shutter assembly 10 or to lock the position of the shutter-slats 30 in a desired position.

A VARIATION OF THE PRESENT INVENTION

A variation of the present invention is embodied in the shutter assembly depicted in FIGS. 7 through 11, which variation is designated generally by the numeral 110. The shutter assembly 110 may, if desired, be divided into two sub-assemblies 111A and 111B to utilize common base members 112A and 112B. Even though the shutter-assembly 110 is depicted in a vertical disposition, it should be understood that a vertical or virtually any other desired disposition may be readily employed.

The shutter assembly 110 depicted is particularly adapted to rectangular openings 116 (FIG. 8) and the laterally spaced, base members 112A and 112B may be parallel. In addition, the variation depicts how one might readily utilize sub-assemblies 111A and 111B arranged in conjunction with a single opening 116. Yachting enthusiasts will immediately recognize the applicability of the variation for use with a hatch in a companionway, where the upper and lower portions of the opening 116 in the hatch may be provided with individually operated shutter sub-assemblies 111A and 111B.

As such, the base members 112A and 112B may be mounted to conform to the shape of opening 116 in the hatch 119. Thus, when the hatch 119 is serving as a "door" the shutter assembly 110 may be mounted on the laterally spaced butte and lock stiles 121 and 123, respectively, by a plurality of mounting fastener means in the nature of screws 124. The stiles 121 and 123, in combination with the top and middle rails 125 and 126, respectively, circumscribe the opening 116, and the base members 112A and 112B define the operating plane 128 within which the shutter sub-assemblies 111A and 111B are disposed and within which plane 128 the shutter-slats 130 of both sub-assemblies 111 are pivotally mounted.

The shutter sub-assemblies 111A and 111B each employ a plurality of the longitudinally extending shutter-slats 130—shutter-slats 130$A_1$, 130$A_2$, etc. in sub-assembly 111A and shutter-slats 130$B_1$, 130$B_2$, etc. in sub-assembly 111B—and the shutter-slats 130 are disposed in parallel relation to each other in at least each sub-assembly. A longitudinal reference axis 132 extends along the longitudinal centerline of each shutter-slat 130 to intersect the first and second ends 134A and 134B, respectively, of the shutter-slats 130. The ends 134A are disposed to lie parallel to the adjacent base member 112A, and the ends 134B are disposed to lie parallel to the adjacent base member 112B.

Because the shutter-slats 130 in each shutter sub-assembly 111A and 111B are disposed in perpendicular relation to both base members 112A and 112B, the ends 134A and 134B of each shutter-slat 130 may be disposed perpendicularly with respect to the longitudinal reference axis 132. Because both ends 134A and 134B of each shutter-slat 130 in each sub-assembly 110 are parallel to the adjacent side members 112A and 112B, and further because the two side members 112 in each shutter sub-assembly 110 are themselves parallel, there is no need for either side member 112 to be notched to accommodate rotation of the shutter-slats 130, as is required in the primary embodiment.

The cross sectional configuration of the shutter-slat 130 depicted is also not critical to the operation of the shutter assembly 110, and here, too, each shutter-slat 130 may have opposed, parallel, planar surfaces 136A and 136B that merge to intersect the apices 138A and 138B through the inclined, transitional surfaces 140$A_1$ and 140$A_2$ on one side of each shutter-slat 130 and through the inclined, transitional surfaces 140$B_1$ and 140$B_2$ on the other side of each shutter-slat 130. The apices 138 may be rounded, or squared, as desired. Irrespective of their exact configuration, the longitudinal extent of the opposite apices 138 define the first and second edges of each shutter-slat 130.

A mounting axis 142 extends longitudinally along the interior of each shutter-slat 130 in proximity to the edge defined by apex 138A of each slat. The mounting axis 142 preferably lies parallel to the longitudinal reference axis 132. An input axis 144 extends longitudinally along the interior of each shutter-slat 130 in proximity to the opposite edge defined by apex 138B of each slat, and the input axis 144 also lies parallel to, but on the opposite side of, the longitudinal reference axis 132.

When the shutter-slats 130 are positioned for operation within the shutter assembly 110, the mounting axis 142 of each shutter-slat 130 is disposed within the operating plane 128, and the shutter-slats 130 are each secured to the base members 112 for the desired rotation about pivot members 146, one of which extends through base member 112A and into the adjacent end 134A of each shutter-slat 130. An opposed pivot member 146 extends through base member 112B and into the adjacent end 134B of each shutter-slat 130. The opposed pivot members 146 are disposed to lie in congruity with the mounting axis 142 of each shutter-slat 130 so that each shutter-slat 130 may rotate about its respective mounting axis 142.

The pivot members 146 also support the weight of each shutter-slat 130. In the variation of the preferred embodiment wood screws may also be employed as the pivot members 146. The present invention also contemplates that means other than screws may be employed as the pivot members 146. Other such means may be molded or otherwise formed directly into the base members 112A and 112B and/or the shutter-slats 130.

At least one actuator, or adjusting, bar 150 is pivotally connected to the input axis 144 of each shutter-slat 130. In the variation 110 two actuator bars 150A and 150B may be used for each shutter sub-assembly 111A and 111B. The additional actuator 150B improves the stability of the shutter sub-assemblies 111. As depicted, the first actuator 150$A_1$ in sub-assembly 111A is pivotally secured to the input axis 144 of each shutter-slat 130$A_1$, 130$A_2$, etc. for the desired simultaneous relative rotation between the shutter-slats 130A and the first actuator 150$A_1$ about the individual input axis 144 of each shutter-slat 130, as defined by the pivot members 147, one of which extends through the actuator 150$A_1$ and into the adjacent end 134A of each shutter-slat 130A in the first shutter sub-assembly 111A. Similarly, the second actuator 150$B_1$ in sub-assembly 111A is pivotally secured to the input axis 144 of each shutter-slat 130$A_1$, 130$A_2$, etc. for the desired simultaneous relative rotation between the shutter-slats 130 and the second actuator 150$B_1$ about the individual input axis 144 of each shutter-slat 130, as defined by the pivot members 147, one of which extends through the actuator 150$B_1$ and into the adjacent end 134B of each shutter-slat 130A in the first shutter sub-assembly 111A.

The actuator bars 150$A_2$ and 150$B_2$ are likewise operably connected to the second shutter sub-assembly 111B. That is, the first actuator 150$B_1$ in sub-assembly 111B is pivotally secured to the input axis 144 of each shutter-slat 130 for the desired relative rotation between the shutter-slats 130 and the second actuator 150$A_2$ about the individual input axis 144 of each shutter-slat 130, as defined by the pivot members 147, one of which extends through the actuator 150$A_2$ and into the adjacent end 134A of each shutter-slat 130 in the second shutter sub-assembly 111A. Similarly, the second actuator 150$B_1$ in sub-assembly 111B is pivotally secured to the input axis 144 of each shutter-slat 130 for the desired relative rotation between the shutter-slats 130 and the second actuator 150$B_2$ about the individual input axis 144 of each shutter-slat 130$B_1$, 130$B_2$, etc., as defined by the pivot members 147, one of which extends through the actuator 150$B_2$ and into the adjacent end 134B of each shutter-slat 130B in the second shutter sub-assembly 111B.

As a result of the geometric relationships between the shutter-slats 130, the base members 112 and the actuators 150 in each sub-assembly 111A or 111B, when the actuators 150 for either sub-assembly 110 are translated, all of the shutter-slats 130 in that sub-assembly 111A or 111B are simultaneously pivoted about their respective mounting axes 142. When the actuators 150 are translated, they remain parallel to the base members 112. When the actuators 150 are translated such that they engage the base members 112, as shown in the lower portion of both FIGS. 10 and 11, the shutter sub-assemblies 111 are closed, and the space between the successive shutter-slats 130 is minimized. As the actuators 150 are translated away from the base members 112, the shutter-slats 130 move toward the open position represented in the upper portion of both FIGS. 10 and 11. When the actuators 150 are farthest away from the base members 112, the shutter sub-assembly 111 is open, and the space between the successive shutter-slats 130 is maximized.

It should be appreciated that when screws are employed as the pivot member 146 and/or 147, the tightness of the screws determines the amount of force necessary to move the actuators 150. When the shutter assembly 110 is installed on a moving conveyance, such as a yacht, the amount of force necessary to adjust the shutter-slats 130 may thus be readily adjusted to prevent the shutter-slats 130 from moving in response to the movement of the yacht. It also follows that the shutter-slats 130 may be locked in any desired position by tightening any one of the screws that serve as the pivot members 146 or 147. When screws are not employed as the pivot members, other devices, such as a thumbscrew, may be interposed between one of the shutter-slats 130 and either side member 112 or the actuator 150 selectively to control the force required to actuate the shutter assembly 110 or to lock the position of the shutter-slats 130 in a desired position.

While only a preferred and one alternative variation of my present invention are disclosed, it is to be clearly understood that the same are susceptible to numerous changes apparent to one skilled in the art. Therefore, the scope of the present invention is not to be limited to the details shown and described but is intended to include all changes and modifications which come within the scope of the appended claims.

As should now be apparent, the present invention not only teaches that a shutter embodying the concepts of the present invention is capable of remaining stable when used in conjunction with openings on conveyances that move about one or more axes, but also that the other objects of the invention can be likewise accomplished.

I claim:

1. A shutter assembly for an opening adapted to admit light and/or air, the opening being surrounded by a frame having at least one oblique member, said shutter assembly comprising:

laterally spaced base members defining a base plane that extends across the opening;

one of said base members being obliquely disposed to the other of said base members;

a plurality of parallel, shutter-slats extending between said base members;

said base member being obliquely disposed with respect to said shutter-slats having a notch therein disposed adjacent to each of said shutter-slats such that said shutter-slat may pivot into said notch to avoid contact with said base member;

each shutter-slat having a longitudinal reference axis, a mounting axis and an input axis;

each said mounting axis being disposed in transversely spaced, parallel relation with respect to said longitudinal reference axis and lying within said base plane;

means securing each said shutter-slat to said base members for pivotal movement of each said shutter-slat about its said mounting axis;

said input axis of each shutter-slat being disposed in transversely spaced, parallel relation with respect to said mounting axis;

at least one actuator;

means securing said actuator to each said shutter-slat for relatively pivotal movement of each said shutter-slat with respect to said actuator about said input axis and thereby simultaneously to effect pivotal movement of each said shutter-slat about its respective mounting axis.

2. A shutter assembly, as set forth in claim 1, wherein each said shutter-slat further comprises:

first and second ends;

first and second edges extending between said first and second ends;

said mounting axis being located in proximity to said first edge; and, said input axis being located in proximity to said second edge.

3. A shutter assembly, as set forth in claim 2, wherein:

said first and second edges extend in substantially parallel relation to each other and to said longitudinal reference axis.

4. A shutter assembly, as set forth in claim 1, wherein:

said actuator is disposed in parallel relation to at least one of said base members.

5. A shutter assembly, as set forth in claim 1, wherein:

said actuator is disposed in substantially perpendicular relation with respect to said longitudinal reference axis of each shutter-slat to which said actuator is pivotally connected.

6. A shutter assembly, as set forth in claim 1, wherein each of said base members has at least one bore therethrough.

7. A shutter assembly, as set forth in claim 6, further comprising fastener means for selectively mounting the shutter assembly to the existing frame.

* * * * *